US006036537A

United States Patent [19]

Wu et al.

[11] Patent Number: 6,036,537

[45] Date of Patent: Mar. 14, 2000

[54] LOCKING MECHANISM FOR ELECTRICAL CONNECTOR

[75] Inventors: Kun-Tsan Wu; Chin-Yi Lai, both of Tu-Chen, Taiwan

[73] Assignee: Hon Hai Precision Ind. Co., Ltd., Taipei Hsien, Taiwan

[21] Appl. No.: 09/109,984

[22] Filed: Jul. 2, 1998

[30] Foreign Application Priority Data

Jul. 4, 1997 [TW] Taiwan ..... 86211261

[51] Int. Cl.[7] ..... H01R 13/73

[52] U.S. Cl. ..... 439/567

[58] Field of Search ..... 439/567, 571–573

[56] References Cited

U.S. PATENT DOCUMENTS 5,738,451 4/1998 Tseng ..... 439/567
5,772,453 6/1998 Tan et al. ..... 439/567

*Primary Examiner*—Gary F. Paumen

[57] ABSTRACT

A locking mechanism for attaching a connector to a PCB having a mounting hole comprises a lock body including an attaching portion for fixedly attaching to the connector. A first and second resilient retaining legs extend from for inserting into the mounting hole of the PCB. A first space is defined between the first and second resilient retaining legs. A deformation facilitating means is arranged on the lock body adjacent to the resilient retaining legs whereby the deformation of the resilient retaining legs can be homogeneously and efficiently transformed to the lock body.

9 Claims, 6 Drawing Sheets

LOCKING MECHANISM FOR ELECTRICAL CONNECTOR

FIELD OF THE INVENTION

The present invention relates to a locking mechanism, and particularly to a locking mechanism for use with electrical connector and having deformation facilitating means thereof thereby facilitating an easy insertion into a mounting hole of a substrate on which the electrical connector is mounted.

DESCRIPTION OF PRIOR ART

In general, for mounting a connector to a substrate or a PCB, the electrical connector has either boardlocks or posts for temporarily holding the connector onto the substrate before the terminal tails are undergone a soldering process. Referring to FIG. 6, a typical board lock of the high-density pin connector 1 is shown and it generally includes a locking body 90 for attaching the connector to the PCB. The locking body 90 is fixedly attached to the connector by a fixing means, for example a bolt and nut arrangement 93. The locking body 90 further includes a pair of resilient retaining legs 91 opposed to each other. Each resilient retaining leg 91 forms a hooked end 92. The resilient retaining legs 91 are designed to be adapted and retained into a mounting hole of a PCB whereby the hooked end 92 thereof abuts against the bottom edge of the mounting hole. By this arrangement, the connector can be suitably positioned onto the PCB before the PCB undergoes a soldering process.

However, the permitted length the resilient retaining legs 91 is quite short which may result in an inadequate mounting of the connector. Since only the resilient retaining legs 91 deforms instead of the whole locking body 90 during the insertion. The force required for adapting the resilient retaining legs 91 is quite large, therefore the mounting of the connector becomes time insufficient and laborious. Furthermore, when an excess force is applied to the printed board, especially when other electronic devices have been mounted on the same board, all the devices that are temporarily mounted thereon will be rendered unstable. If the PCB undergoes a soldering process, poor connection between the electronic devices and the PCB will result.

Furthermore, the resilient retaining leg 91 has a three-dimensional design, making the manufacture thereof laborious and cost inefficient thereby reducing the competitiveness of the connector.

SUMMARY OF THE INVENTION

One objective of the present invention is to provide a locking mechanism for connecting an article such as a connector a substrate such as a PCB.

Another objective of the present invention is to provide a locking mechanism which can be readily and homogeneously deformed whereby resilient legs thereof can be easily and tactilely adapted to insert into a mounting hole of a PCB.

Another objective of the present invention is to provide a locking mechanism having a first deformation facilitating means whereby the deformation of the locking mechanism can be uniformly transferred to the entire locking mechanism.

Still another objective of this invention is to provide a locking mechanism having a planar configuration resulting in a cost effective manufacturing process whereby a locking body thereof can be formed from a single stamping process.

In order to achieve the objectives set forth, a locking mechanism for attaching an article onto a substrate having a mounting hole is provided. The locking mechanism comprises a lock body including an attaching portion for fixedly attaching to a connector. First and second resilient retaining legs extend from the lock body for inserting into the mounting hole of the substrate. A first space is defined between the resilient retaining legs. A deformation facilitating means is arranged on the lock body whereby the deformation of the resilient retaining legs is homogeneously and efficiently transformed to the lock body.

According to another embodiment of the present invention, an electrical connector attached to a PCB having mounting hole includes a locking mechanism thereof. The electrical assembly includes a connector assembly electrically connected with a mating connector. The locking mechanism comprises a lock body including an attaching portion for fixedly attaching to the connector assembly. First and second resilient retaining legs extend from the lock body for inserting into the mounting hole of the substrate. A first space is defined between the resilient retaining legs. A deformation facilitating means is arranged on the lock body whereby the deformation of the resilient retaining legs is homogeneously and efficiently transformed to the lock body.

These and additional objects, features, and advantages of the present invention will become apparent after reading the following detailed description of the preferred embodiment of the invention taken in conjunction with the appended drawing.

DETAILED DESCRIPTION OF THE PREFERRED EMBODIMENT

Figure 4:
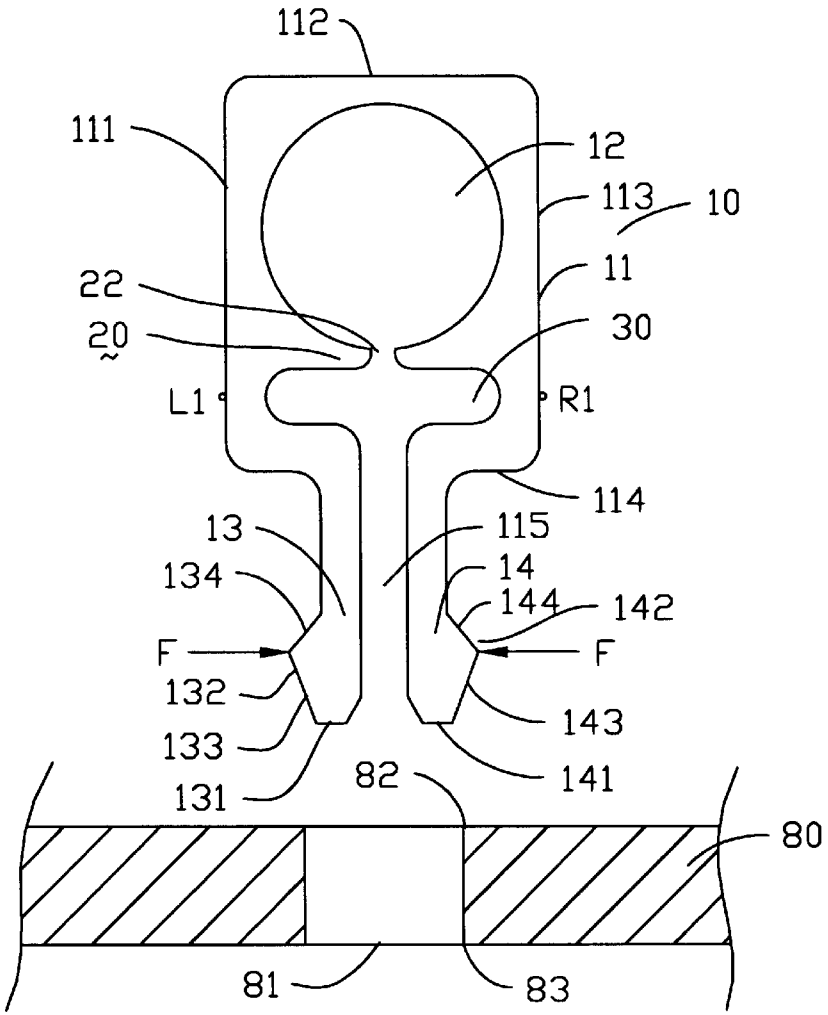
FIG. 4 is a schematic illustration of the board lock before insertion into a mounting hole of the PCB.
Figure 5:
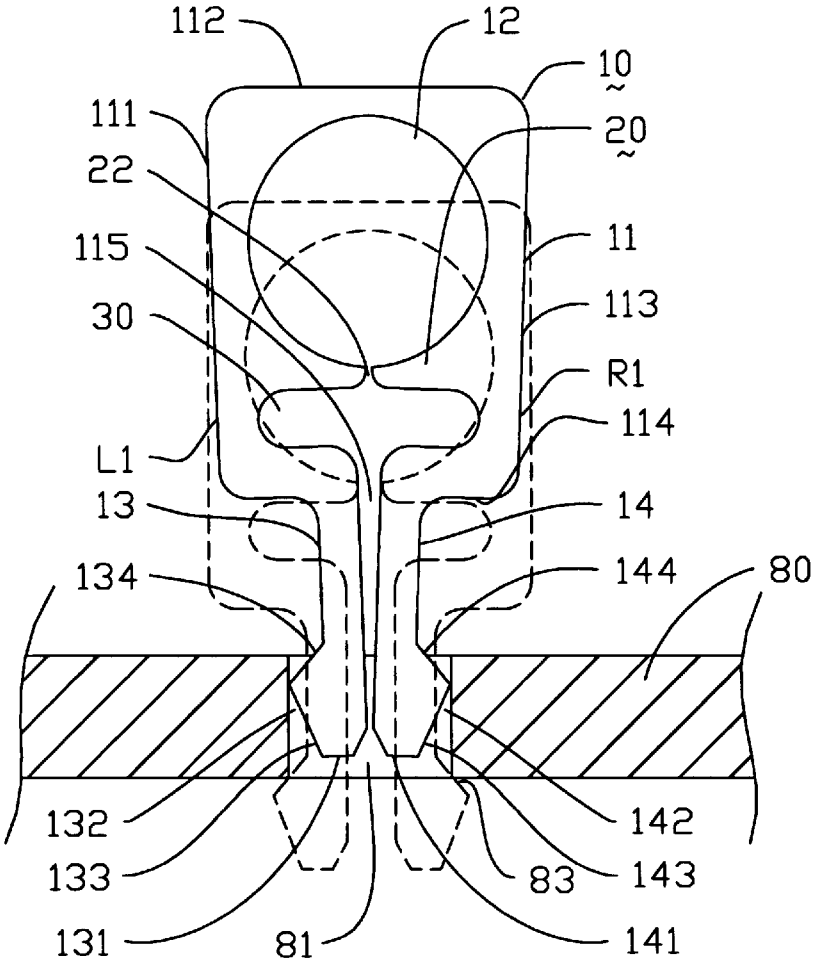
FIG. 5 is a schematic illustration of the board lock showing steps of insertion into the mounting hole of the PCB.
Figure 6:
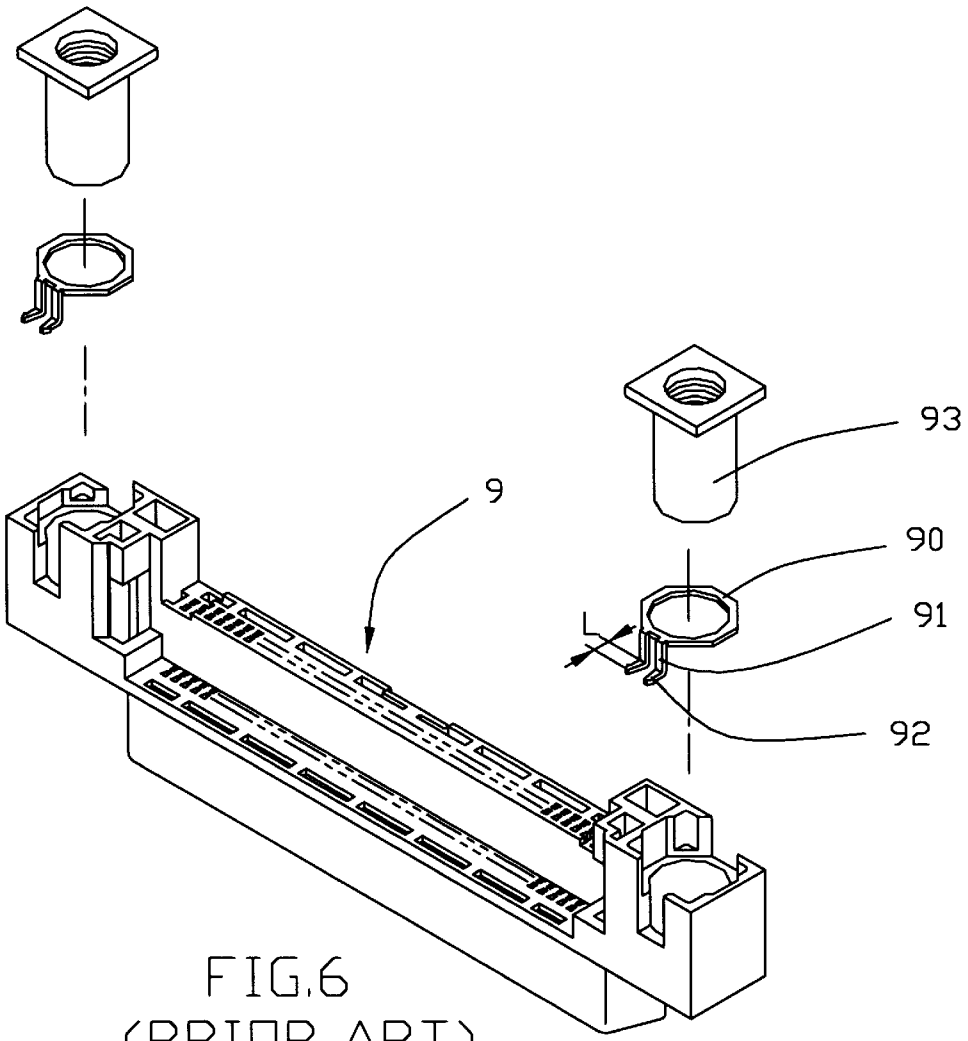
FIG.6 (PRIOR ART)
FIG. 6 is an exploded view of an electrical connector having a conventional board lock thereof.

Referring to FIGS. 4 and 5, a locking mechanism in accordance with a preferred embodiment of the present invention comprises a board lock 10 including a rectangular lock body 11 defining a first, second, third and fourth sides 111, 112, 113, and 114. The lock body 11 is stamped from a metal sheet and has a planar configuration. The lock body 11 defines an attaching hole 12 with which the lock body 11 is fixedly attached to the connector (not shown). The attaching hole 12 has an equal distance from the first, second and third sides 111, 112 and 113. A pair of resilient retaining legs 13, 14 is formed extending from the fourth sides 114 of the lock body 11 and defines a first space 115 therebetween. Each resilient retaining leg 13, 14 further has an outward protrusion 132, 142 formed thereon, and each protrusion 132, 142 forms a leading beveled surface 133, 143 and a retaining beveled surface 134, 144.

In order to provide a homogeneous deformation over the entire lock body 11, the lock body 11 includes a deformation facilitating means 20 defining a cutout 22 arranged between the attaching hole 12 and the first space 115 defined between the resilient retaining legs 13, 14. Since the attaching hole 12 is communicated with the first space 115, the lock body 11 divides into a left half L and a right half R. Accordingly, when an external force F is applied to the resilient retaining legs 13, 14, through the protrusion 132, 142, the left half L and the right half R will undergoes an inward deformation centered on the point A located on the second side 112 of the lock body 11. By this arrangement, the deformation is smoothly distributed to the entire lock body 11.

Besides, as the length between the free end 131 (141) to the fourth side 114 of the lock body 11 is considerably smaller than the distance between the free end 131 (141) to the point A of the second side 112 of the lock body 11, the left half L and the right half R is easily deformed with reduced force as compared to the conventional board lock.

Figure 2:
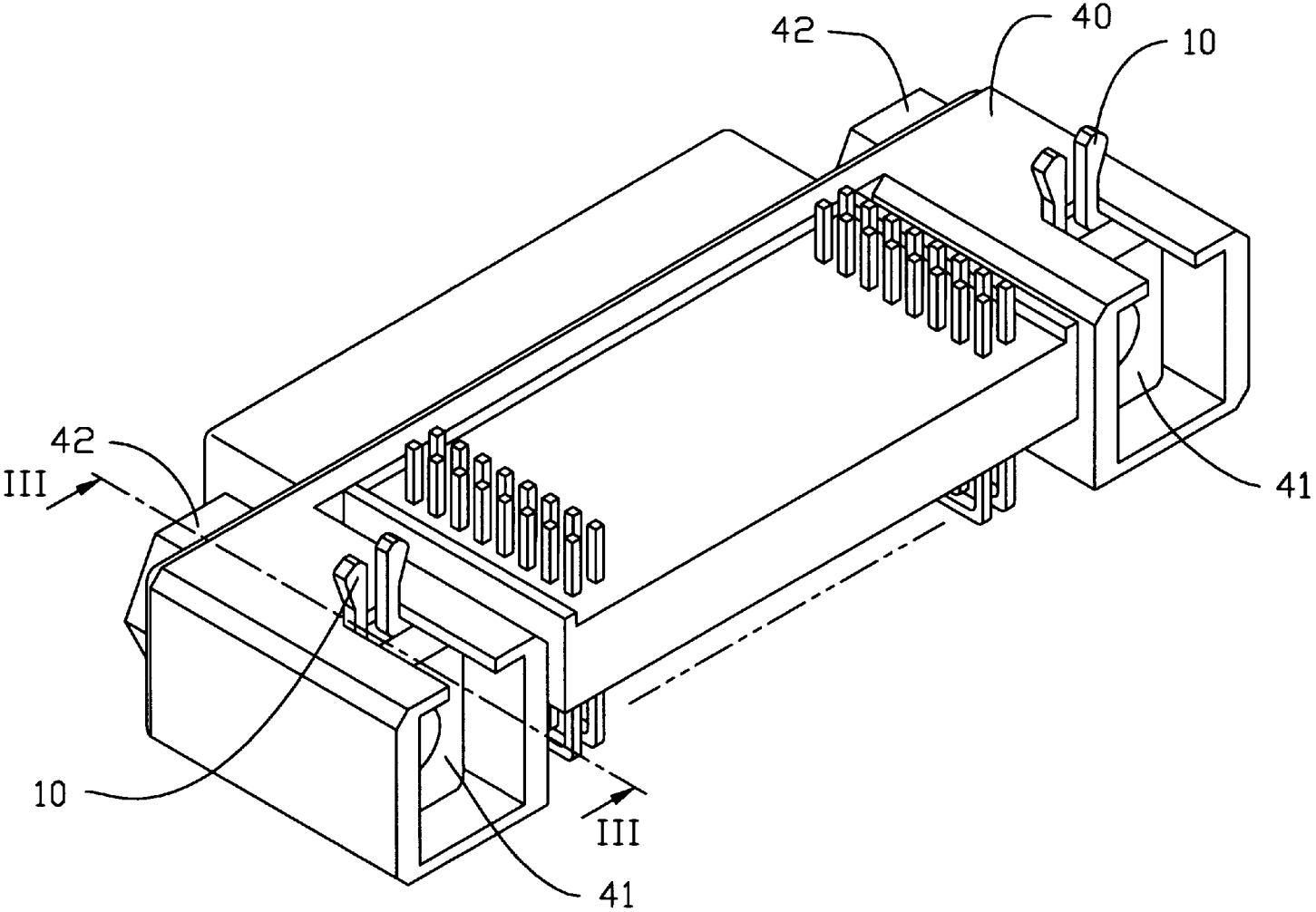
FIG. 2 is a perspective view of the assembled electrical connector of FIG. 1.
Figure 3:
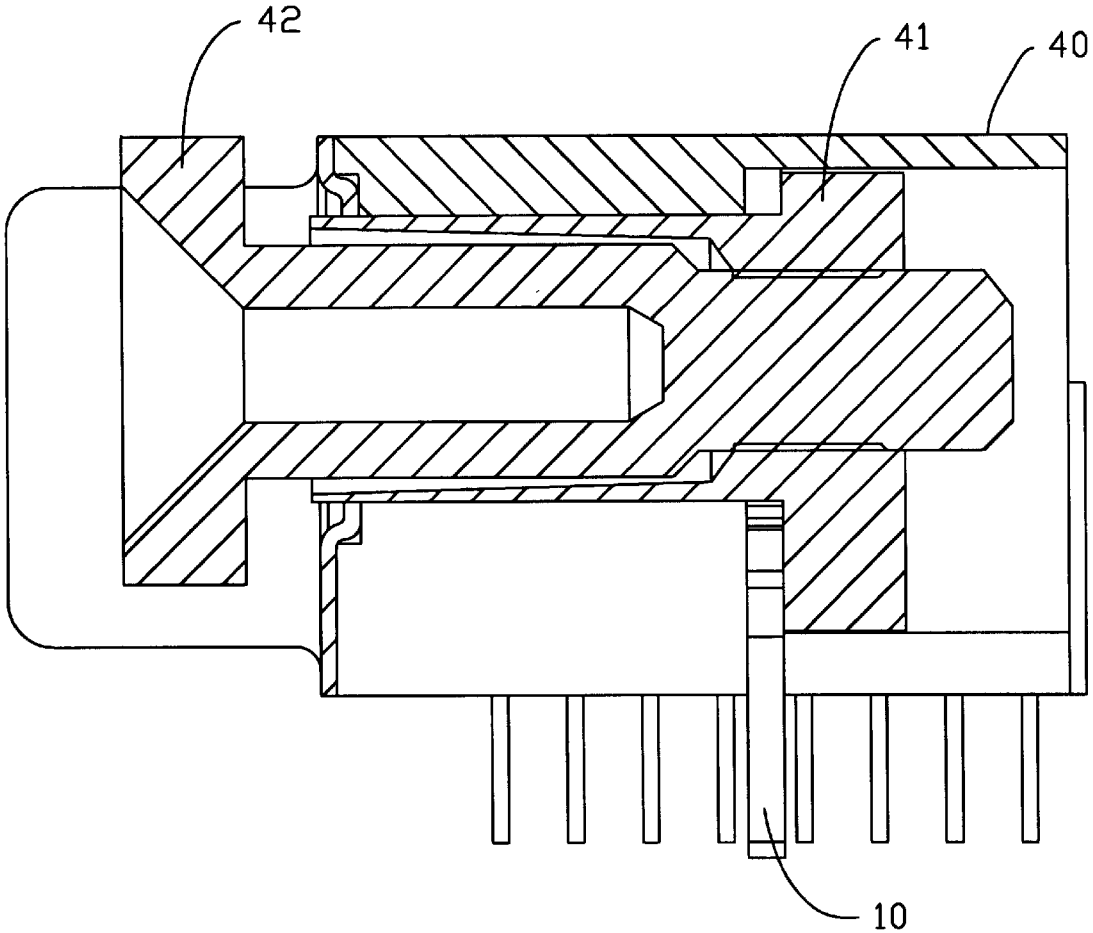
FIG. 3 is a cross sectional view taken along line III—III of FIG. 2.

In an alternative embodiment in of the board lock 10, a second deformation facilitating device 30 is defined between the cutout 21 and the first space 115 located between the resilient retaining legs 13, 14. The provision of the second deformation facilitating means 30 is advantageous since the point R1 of the third side 113 and the point L1 of the first side 111 may also serve as a pivoting point for the first retaining leg 13 and the second retaining leg 14. For example, when the board lock 10 is attached to the connector by means of a riveting process, see FIGS. 2 and 3. In some case, the first, second and third sides 111, 112 and 113 may be fixedly sandwiched by the bolt and nut arrangement 41, 42. However, as the second deformation facilitating means 30 is provided, the first retaining leg 13 and the second retaining leg 14 may still pivot centering on the points R1 and L1 respectively. Alternatively, if the first, second and third sides 111, 112 and 113 are still free to move after attachment, the point A may again serve as the pivoting point of the left half L and the right half R. By this arrangement, the deformation of the resilient retaining legs 13, 14 can be homogeneously distributed to the entire lock body 10.

Referring to FIG. 4, the PCB 80 includes a mounting hole 81 defining an upper edge 82 and a lower edge 83. When the first and second resilient retaining legs 13, 14 of the board lock 11 are adapted into the mounting hole 81 of the PCB 80, the leading beveled surface 133 (143) of the protrusion 132 (142) will initiate a deformation of the resilient retaining legs 13, 14 to facilitate the inserting. As the deformation is smoothly distributed to the entire locking body 11, the inserting of the board lock 11 can be readily done.

Figure 1:
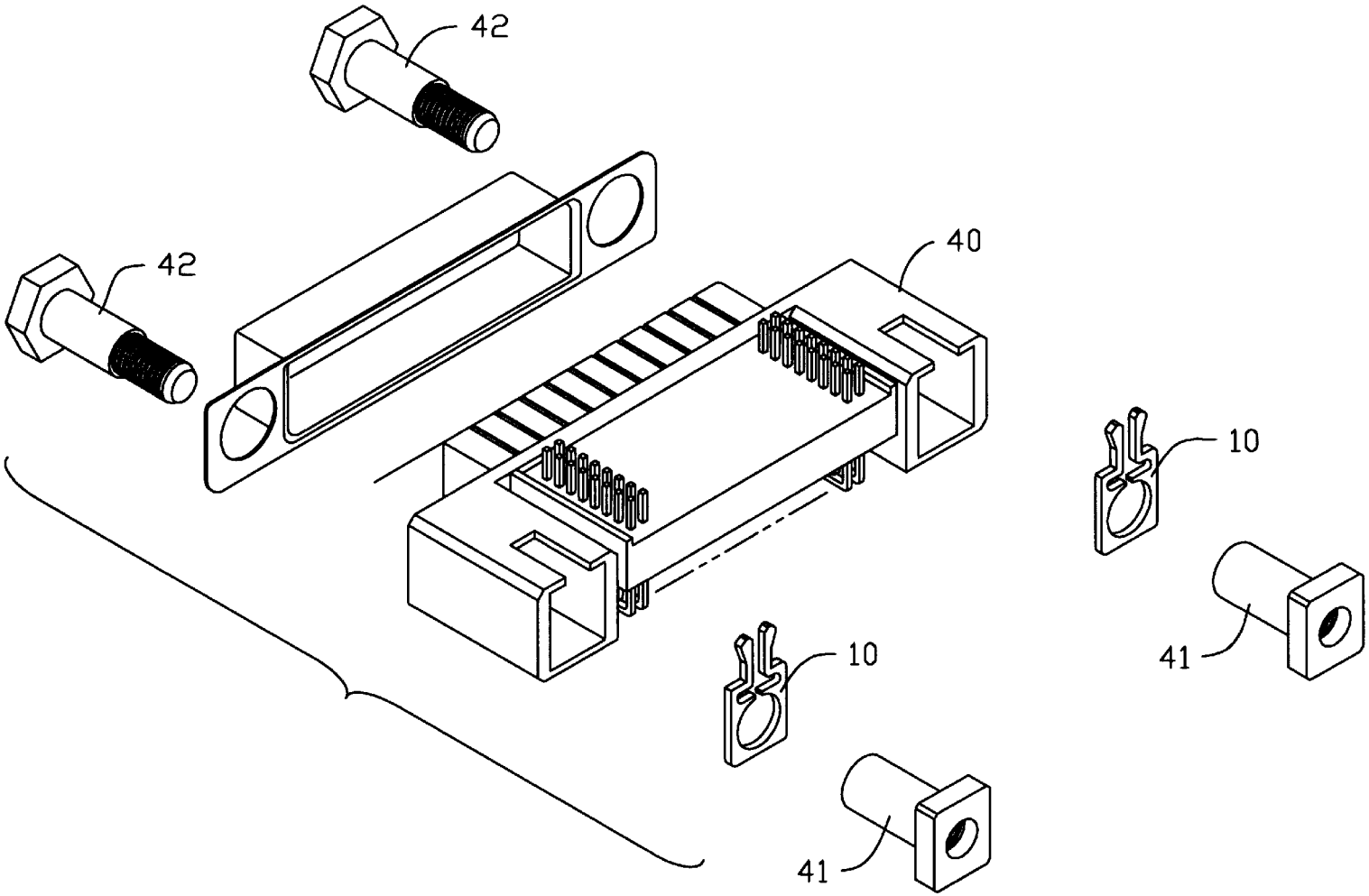
FIG. 1 is an exploded view of an electrical connector having an improved board lock in accordance with a preferred embodiment of the present invention.

The board lock 10 in accordance with the present invention may readily attach any connector to a PCB or a substrate. Referring to FIG. 1, the board lock 10 can be attached to the connector 40 by means of a bolt and nut arrangement 41, 42. In order to provide a robust mounting, the connection between the attaching hole 11 of the board lock 10 and bolt and nut arrangement 41, 42 is a loose fit. As a result, the board lock 10 is automatically adjusted to align with the mounting hole 81 of the PCB 80 when it is inserted into the mounting hole 81. Because the board lock 10 is fixedly enveloped onto the bolt and nut arrangement 41, 42, the connector 40 is firmly attached to the PCB when the resilient retaining legs 13, 14 are retained within the mounting hole 81 of the PCB 80.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

Therefore, persons of ordinary skill in this field are to understand that all such equivalent structures are to be included within the scope of the following claims.

We claim:

1. A locking mechanism for attaching an article onto a substrate having a mounting hole, comprising:

a lock body including an attaching hole for fixedly attaching to the article;

first and second resilient retaining legs extending from said lock body for inserting into said mounting hole of said substrate, and defining a first space therebetween; and first deforming facilitating means arranged on said lock body adjacent to said resilient retaining legs and communicating said attaching hole to said first space, whereby the deformation of said resilient retaining legs is homogeneously and efficiently transformed to said lock body;

wherein said facilitating means includes a cutout much narrower than said attaching hole.

2. A locking mechanism as recited in claim 1, wherein said lock body further includes a second deformation facilitating means formed between said first deformation facilitating means and said resilient retaining legs.

3. A locking mechanism as recited in claim 2, wherein said second deformation means is a second space transversely arranged with respect to said resilient retaining legs.

4. A locking mechanism as recited in claim 1, wherein each said resilient retaining legs forms an outward protrusion at the free end thereof, said protrusion defining a leading beveled surface which slides along an upper edge of said mounting hole thereby guiding said retaining leg during insertion into said mounting hole of said substrate, and a retaining beveled surface which engages with a lower edge of said mounting hole after insertion of said retaining legs therethrough thereby retaining said locking mechanism in said mounting hole of said substrate.

5. An electrical connector assembly having a planar locking mechanism for attaching to a printed circuit board having a mounting hole, comprising:

a connector, said locking mechanism including:

a lock body including an attaching hole for fixedly attaching to the connector;

first and second resilient retaining legs extending from said lock body for inserting into said mounting hole of said substrate, and defining a first space therebetween; and first deforming facilitating means arranged on said lock body adjacent to said resilient retaining legs, said first deformation facilitating means including a cutout much narrower than said attaching hole which communicates said attaching hole to said first space, whereby the deformation of said resilient retaining legs is homogeneously and efficiently transformed to said lock body.

6. An electrical connector assembly as recited in claim 5, wherein said lock body further includes a second deformation facilitating means formed between said first deformation facilitating means and said resilient retaining legs.

7. An electrical connector assembly as recited in claim 6, wherein said second deformation means is a second space transversely arranged with respect to said resilient retaining legs.

8. An electrical connector assembly as recited in claim 5, wherein each said resilient retaining leg forms an outward protrusion at the free end thereof, said protrusion defining a leading beveled surface which slides along an upper edge of said mounting hole thereby guiding said retaining leg during insertion into said mounting hole of said substrate, and a retaining beveled surface which engages with a lower edge of said mounting hole after insertion of said retaining legs therethrough thereby retaining said locking mechanism in said mounting hole of said substrate.

9. A planar plate-like locking mechanism for attaching an article onto a substrate having a mounting hole, comprising:

a lock body including an attaching hole for fixedly attaching to said article, said lock body forming therein a cutout much narrower than said attaching hole and in communication with said attaching hole; and first and second resilient retaining legs extending from said lock body for inserting into said mounting hole of said substrate, and a first space between said resilient retaining legs and in communication with said cutout whereby the deformation of said resilient retaining legs is homogeneously and efficiently transformed to said lock body.

* * * * *